US009000984B2

(12) United States Patent
Rao et al.

(10) Patent No.: US 9,000,984 B2
(45) Date of Patent: Apr. 7, 2015

(54) MULTIPLE INPUT, MULTIPLE OUTPUT ANTENNA FOR HANDHELD COMMUNICATION DEVICES

(75) Inventors: Qinjiang Rao, Waterloo (CA); Dong Wang, Waterloo (CA)

(73) Assignee: BlackBerry Limited, Waterloo (CA)

( * ) Notice: Subject to any disclaimer, the term of this patent is extended or adjusted under 35 U.S.C. 154(b) by 410 days.

(21) Appl. No.: 13/447,418

(22) Filed: Apr. 16, 2012

(65) Prior Publication Data

US 2012/0200462 A1 Aug. 9, 2012

Related U.S. Application Data

(63) Continuation of application No. 12/364,932, filed on Feb. 3, 2009, now Pat. No. 8,179,324.

(51) Int. Cl.

| | |
|---|---|
| ***H01Q 1/38*** | (2006.01) |
| ***H01Q 9/04*** | (2006.01) |
| ***H01Q 21/28*** | (2006.01) |

(52) U.S. Cl.

CPC ..... *H01Q 9/045* (2013.01); *H01Q 1/38* (2013.01); *H01Q 9/0421* (2013.01); *H01Q 21/28* (2013.01)

(58) Field of Classification Search

CPC ..... H01Q 1/38; H01Q 9/0407; H01Q 9/0421; H01Q 1/243; H01Q 5/0003

USPC ..... 343/700 MS, 702, 745, 846, 767

See application file for complete search history.

(56) References Cited

U.S. PATENT DOCUMENTS

| | | | |
|---|---|---|---|
| 5,547,100 | A | 8/1996 | Johnson |
| 5,633,646 | A | 5/1997 | Strickland |
| 6,448,933 | B1 | 9/2002 | Hill et al. |
| 6,515,627 | B2 | 2/2003 | Lopez et al. |
| 6,593,887 | B2 | 7/2003 | Luk et al. |
| 6,614,401 | B2 | 9/2003 | Onaka et al. |

(Continued)

FOREIGN PATENT DOCUMENTS

| | | | |
|---|---|---|---|
| EP | 1077505 | A2 | 2/2001 |
| EP | 116288 | A1 | 12/2001 |

(Continued)

OTHER PUBLICATIONS

Antonio Forenza et al., Benefit of Pattern Diversity via Two-Element Array of Circular Patch Antennas in Indoor Clustered MIMO Channels, IEEE Transactions on Communications, vol. 54, No. 5, pp. 943-954, May 2006.

(Continued)

*Primary Examiner* — Huedung Mancuso
(74) *Attorney, Agent, or Firm* — Moffat & Co.

(57) ABSTRACT

An antenna assembly for a mobile wireless communication device has a support with a first surface and a second surface between which a third surface and a fourth surface extend. A conductive ground plane is formed on the second surface. An antenna includes an electrically conductive patch located on the first surface, and first and second electrically conductive legs and an electrically conductive stripe all abutting the patch. In one version the first and second legs and the strip are all on the third surface. In another version the first and second legs are on the third surface and the strip is on the fourth surface that is orthogonal to the third surface. A first signal port is adapted to apply a first signal to the first leg and a second signal port is adapted to apply a second signal to the third leg.

12 Claims, 4 Drawing Sheets

(56) References Cited

U.S. PATENT DOCUMENTS

| | | | | |
|---|---|---|---|---|
| 6,650,294 | B2 | 11/2003 | Ying et al. | |
| 6,856,286 | B2 | 2/2005 | Farrar et al. | |
| 6,891,504 | B2 * | 5/2005 | Cheng et al. | 343/700 MS |
| 6,924,769 | B2 * | 8/2005 | Ito et al. | 343/702 |
| 6,950,071 | B2 | 9/2005 | Wen et al. | |
| 7,023,387 | B2 | 4/2006 | Wen et al. | |
| 7,038,627 | B2 | 5/2006 | Ikuta et al. | |
| 7,109,923 | B2 | 9/2006 | Ollikainen et al. | |
| 7,283,097 | B2 | 10/2007 | Wen et al. | |
| 7,289,068 | B2 | 10/2007 | Fujio et al. | |
| 7,352,328 | B2 | 4/2008 | Moon et al. | |
| 7,369,089 | B2 | 5/2008 | Wen et al. | |
| 7,372,412 | B2 * | 5/2008 | Koide | 343/702 |
| 7,400,300 | B2 | 7/2008 | Qi et al. | |
| 7,403,165 | B2 | 7/2008 | Qi et al. | |
| 8,350,764 | B2 * | 1/2013 | Rao et al. | 343/702 |
| 2004/0080457 | A1 | 4/2004 | Guo et al. | |
| 2004/0085245 | A1 | 5/2004 | Miyata et al. | |
| 2006/0044186 | A1 | 3/2006 | Coppi et al. | |
| 2006/0234657 | A1 | 10/2006 | Boyle | |
| 2007/0109204 | A1 | 5/2007 | Phillips et al. | |
| 2008/0062058 | A1 | 3/2008 | Bishop | |
| 2008/0122698 | A1 | 5/2008 | Ollikainen et al. | |
| 2008/0231530 | A1 | 9/2008 | Rao et al. | |
| 2008/0284661 | A1 | 11/2008 | He | |
| 2008/0287171 | A1 | 11/2008 | Qi et al. | |

FOREIGN PATENT DOCUMENTS

| | | | |
|---|---|---|---|
| EP | 1162688 | A1 | 12/2011 |
| JP | 20080167393 | | 7/2008 |
| WO | 2004015810 | A1 | 2/2004 |
| WO | 2008001169 | A2 | 1/2008 |
| WO | 2008049354 | A1 | 5/2008 |

OTHER PUBLICATIONS

Thomas Svantesson, Correlation and Channel Capacity of MIMO Systems Employing Multimode Antennas, IEEE Transactions on Vehicular Technology, vol. 51, No. 6, pp. 1304-1312, Nov. 2002.

Rodney G. Vaughan, Two-Port Higher Mode Circular Microstrip Antennas, IEEE Transactions on Antennas and Propagation, vol. 36, No. 3, pp. 309-321, Mar. 1988.

Chou et al., Investigations of Isolation Improvement Techniques for Multiple Input Multiple Output (MIMO) WLAN Portable Terminal Applications; Progress in Electromagnetics Research, PIER 85, 349-366, 2008.

Ki-Jin Kim et al., High Isolation Internal Dual-Band Planar Inverted-F Antenna Diversity System with Band Notched Slots for MIMO Terminals, 36th European Microwave Conference, Sep. 2006, pp. 1414-1417.

International Preliminary Report on Patentability for PCT Application No. PCT/CA2010/000123, mailed Aug. 18, 2011.

M. Karaboikis et al., Compact Dual-Printed Inverted-F Antenna Diversity Systems for Portable Wireless Devives, IEEE Antennas and Wireless Propagation Letters. vol. 3, 2004.

EP Search Report for Patent Application No. 10152570.7, mailed Mar. 2, 2010.

Christian Waldschmidt et al., Compact Wide=Band Multimode Antennas for MIMO and Diversity, IEEE Transactions on Antennas and Propagation, vol. 52, No. 8, pp. 1963-1969, Aug. 2004.

International Search Report for Patent Application No. PCT/CA2010/000123, mailed Mar. 31, 2010.

* cited by examiner

MULTIPLE INPUT, MULTIPLE OUTPUT ANTENNA FOR HANDHELD COMMUNICATION DEVICES

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND

The present invention relates generally to antennas for handheld communication devices, and more particularly to multiple input, multiple output antennas.

Different types of wireless mobile communication devices, such as personal digital assistants, cellular telephones, and wireless two-way email communication equipment are available. Many of these devices are intended to be easily carried on the person of a user, often fitting in a shirt or coat pocket.

As the use of wireless communication equipment continues to grow dramatically, a need exists provide increased system capacity. One technique for improving the capacity is to provide uncorrelated propagation paths using Multiple Input, Multiple Output (MIMO) systems. MIMO employs a number of separate independent signal paths, for example by means of several transmitting and receiving antennas.

This typically requires multiple antennas which results in duplication of certain parts within the wireless mobile communication device, and results in an unfavorable trade-off between device size and performance. The trade-off is that smaller devices suffer performance problems, including shortened battery life and potentially more dropped calls, whereas devices with better performance require larger housings. The primary factor of this trade-off is mutual coupling between the antennas, which can result in wasted power when transmitting and a lower received power from incoming signals.

Effective MIMO performance requires relatively low correlation between each signal received by the multiple antennas. This is typically accomplished in large devices using one or more of: spatial diversity (distance between antennas), pattern diversity (difference between antenna aiming directions), and polarization diversity.

Unfortunately, when multiple antennas are used within a mobile handheld communication device, the signals received by those antennas are undesirably correlated, due to the tight confines typical of the compact devices that are favored by consumers. This noticeably disrupts MIMO performance. The trade-off is then to either enlarge the device, which consumers will likely shun, or else tolerate reduced performance.

Therefore, is it desirable to develop an MIMO antenna arrangement which is capable has a compact size to fit within a device housing small enough to be desired by consumers and which has improved performance.

DETAILED DESCRIPTION

The present antenna for a mobile wireless communication device uses fewer components and reduces signal correlation by reducing antenna coupling, even when implemented in a more compact form than prior systems. This is achieved with a geometric design that enables a single element to fulfill the roles which previously required by two individual antennas.

The antenna design is based on merging two planar inverted F-antennas (PIFAs) with a common strip and a common ground plane to provide a compact design that is well suited for a diversity antenna system in a mobile handheld device. Alternatively the antenna could also be utilized as a duplexer allowing the receive and transmit signals to be separated.

The antenna comprises a patch of electrically conductive material located in a first plane. A first leg and a second leg are spaced apart and both are formed of electrically conductive material that is electrically connected to the patch. The first and second legs are coplanar and transverse to the first plane. An electrically conductive strip is connected to the patch and to the first leg, wherein the strip is transverse to the first plane. A third leg is electrically connected to and projects away from the strip. The antenna has a first signal port for applying a first signal to the first leg, and a second signal port for applying a second signal to the third leg.

The present antenna is advantageously useful with mobile wireless communication devices, such as personal digital assistants, cellular telephones, and wireless two-way email communication devices, and will be described in that context. Nevertheless this antenna may be employed with other types of radio frequency equipment.

Figure 1:
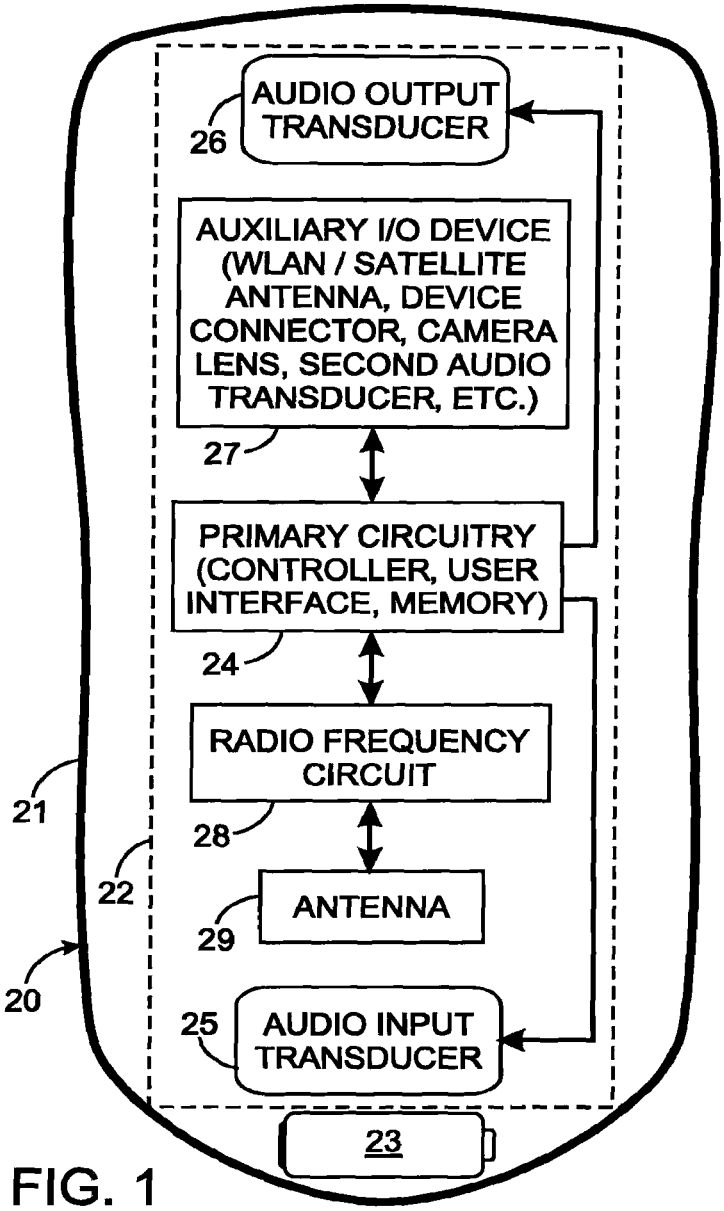
FIG. 1 is a schematic block diagram of a mobile wireless communication device that incorporates the present antenna assembly.

Referring initially to FIG. 1, a mobile wireless communication device 20, such as a cellular telephone, illustratively includes a housing 21 that may be a static housing, for example, as opposed to a flip or sliding housing which are used in many cellular telephones. Nevertheless, those and other housing configurations also may be used. A battery 23 is carried within the housing 21 for supplying power to the internal components.

The housing 21 contains a main dielectric substrate 22, such as a printed circuit board (PCB) substrate, for example, on which is mounted the primary circuitry 24 for mobile device 20. That primary circuitry 24, typically includes a microprocessor, one or more memory devices, along with a display and a keyboard that provide a user interface for controlling the mobile device.

An audio input device, such as a microphone 25, and an audio output device, such as a speaker 26, function as an audio interface to the user and are connected to the primary circuitry 24.

Communication functions are performed through a radio frequency circuit 28 which includes a wireless signal receiver and a wireless signal transmitter that are connected to a MIMO antenna assembly 29. The antenna assembly 29 can be carried within the lower portion of the housing 21 and will be described in greater detail herein.

The mobile wireless communication device 20 also may comprise one or auxiliary input/output devices 27, such as, for example, a WLAN (e.g., Bluetooth®, IEEE. 802.11) antenna and circuits for WLAN communication capabilities, and/or a satellite positioning system (e.g., GPS, Galileo, etc.) receiver and antenna to provide position location capabilities, as will be appreciated by those skilled in the art. Other examples of auxiliary 110 devices 27 include a second audio output transducer (e.g., a speaker for speakerphone operation), and a camera lens for providing digital camera capabilities, an electrical device connector (e.g., USB, headphone, secure digital (SD) or memory card, etc.).

Figure 2:
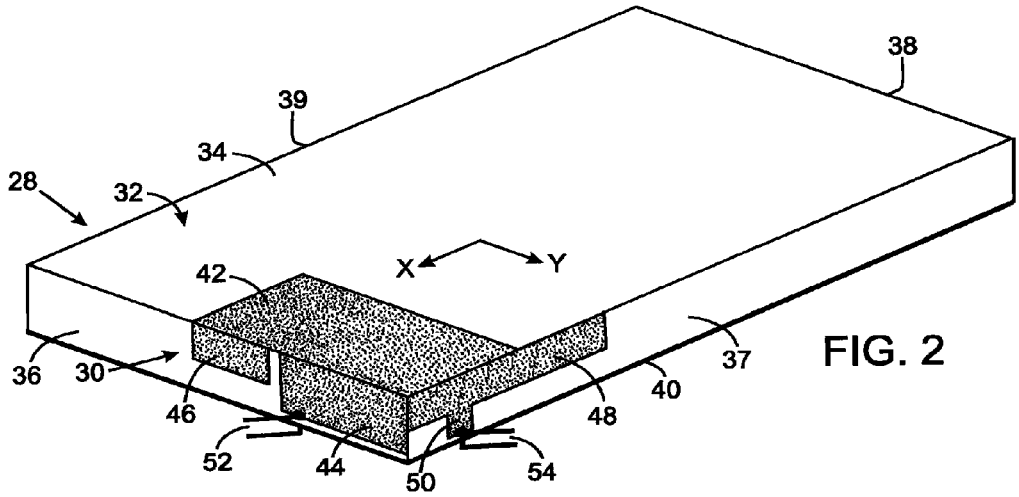
FIG. 2 is a perspective view from above a dielectric support on which a two port antenna assembly of the communication device is mounted.
Figure 3:
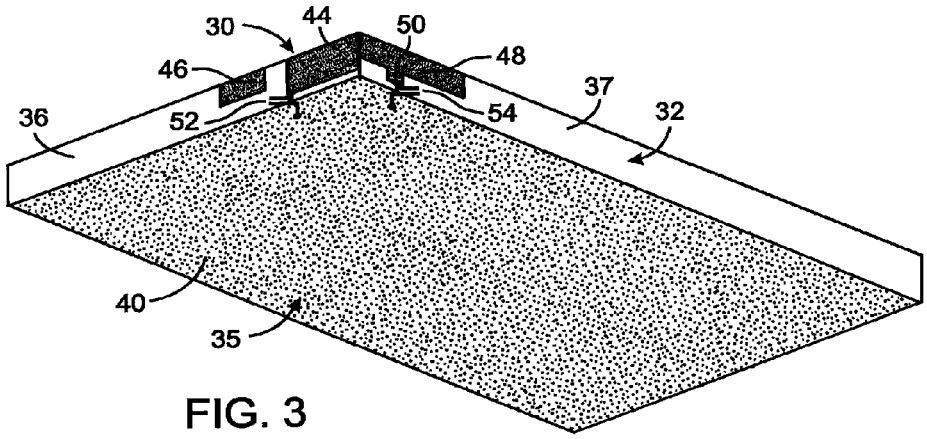
FIG. 3 is a perspective view from below the dielectric support.

With reference to FIGS. 2 and 3, the antenna assembly 28 comprises a single element antenna 30 formed by conductive members on selected surfaces of a support frame 32. The support frame 32 can be a rectangular polyhedron, such as an internal enclosure within the outer housing 21 of the mobile wireless communication device 20. The support frame 32 may have another shape, such a circular or elliptical, for example. The support frame 32 is formed of dielectric material of a type conventionally used for printed circuit boards. The support frame 32 has a major first surface 34 and an opposite, parallel major second surface 35, which has a layer 40 of conductive material, such as copper, applied thereto. The conductive layer 40 functions as the ground plane of the mobile wireless communication device. A third surface 36 and a fourth surface 37 extend between the first and second surfaces 34 and 35 and are orthogonal to each other and to the first and second surfaces, thereby forming two adjacent corners of a rectangular polyhedron. As used herein, a "corner" is defined as the point at which three surfaces meet. A fifth surface 38 and a sixth surface 39 also extend between the first and second surfaces 34. The third, fourth, fifth and sixth surfaces form sides surfaces of the support.

A rectangular patch 42 of conductive material is located on the first surface 34 at one corner of the support and extends along the two adjacent edges where the first surface abuts the third and fourth surfaces 36 and 37, as shown particularly in FIG. 2. A conductive first leg 44, preferably with a rectangular shape, is located at a corner of the third surface 36 along the edges at which the third surface abuts the first surface 34 and the fourth surface 37. The conductive first leg 44 is electrically connected to the conductive patch 42 along the edge between the first and second surfaces 34 and 36. The first leg 44, however, is spaced from the edge at which the third surface 36 abuts the second surface 35 and thus is not an electrical contact with the ground plane conductive layer 40, as shown in FIG. 3. A conductive second leg 46, preferably having a rectangular shape, also is located on the third surface 36 spaced from the first leg 44. The second leg 46 extends along the edge at which the third surface 36 abuts the first surface 34 and is electrically connected to the patch 42 on the first surface 34. The second leg 46 is smaller than the first leg 44 and is on a remote side of the first leg from the fourth surface 37. Preferably the first and second legs 44 and 46 abut the patch 42 so as to be contiguous therewith.

A conductive strip 48 is located on the fourth surface 37 and extends along the two edges at which the fourth surface abuts the first and third surfaces 34 and 36, respectively. The conductive strip 48 is electrically connected at those edges to the patch 42 and the first conductive leg 44. The conductive strip 48 extends approximately half the distance between the first and second surfaces 34 and 35, for example. In addition, the conductive strip 48 extends along the edge between the first and fourth surfaces 34 and 37 approximately twice the distance that the conductive patch 42 extends along that edge, for example. A conductive third leg 50 projects, like a tab, from the strip 48 toward the edge at which the fourth surface 37 abuts the second surface 35 and is spaced from that edge so as to be electrically isolated from the ground plane, conductive layer 40. Preferably the conductive strip 48 abuts the patch 42 and the first leg 44 so as to be contiguous therewith. The conductive strip 48 and the first and third legs 44 and 50 that are contiguous to the strip, form an inverted F-element.

A first signal port 52 is provided by electrical contacts on the first leg 44 and the ground plane 40. A second signal port 54 is provided by contacts with the third leg 50 of the conductive strip 48 and the ground plane, conductive layer 40.

The first and second signal ports 52 and 54 are connected to the radio frequency circuit 28 which can use the antenna to transmit signals in several different modes. In one mode, the excitation signal is applied to the first signal port 52, while the second port 54 is terminated by a 50 Ohm impedance, for example. In a second mode, the first port 52 is terminated with a 50 Ohm impedance, for example, and the excitation signal is applied to the second port 54. Alternatively, two separate excitation signals can be applied simultaneously to the antenna 30, one excitation signal to each of the two signal ports 52 and 54. Each signal port excites the antenna with a two-way current distribution in the X or Y direction or two-way polarizations in order to achieve polarization diversity. Since the direction of the currents from the two signal ports 52 and 54 are almost opposite, the current coupling between the ports is relatively low, thereby achieving high isolation between those ports.

Figure 4:
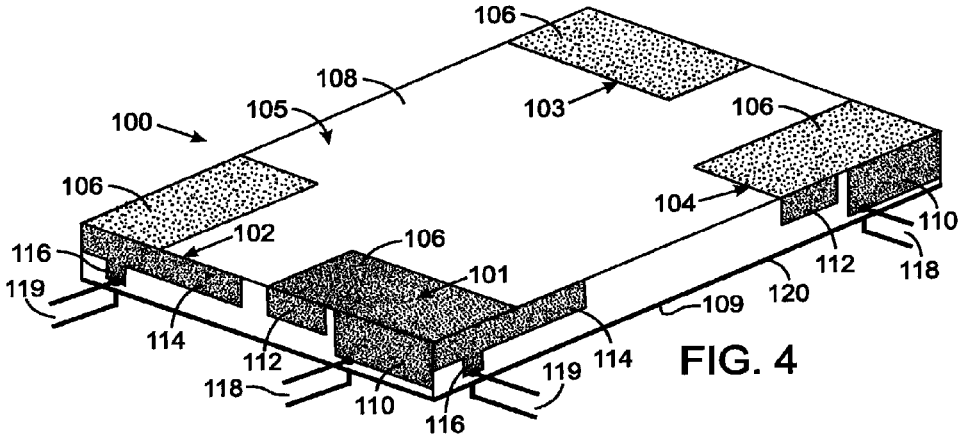
FIG. 4 is a perspective view of an eight port antenna assembly that has antenna elements in the corners of a rectangular support.

With reference to FIG. 4, four of the single element, dual-port antennas are provided on the same mobile wireless communication device 20 to form an eight port antenna assembly 100, however other numbers of antennas can be provided. In this exemplary assembly, the rectangular polyhedron support 105 carries four dual-port antennas 101, 102, 103 and 104, one located at each corner of a first surface 108. Each of the antennas 101-104 has the same general structure as that of the dual-port antenna 30 shown in FIGS. 2 and 3. Specifically each antenna 101-104 has a rectangular patch 106, at one corner adjacent the first surface 108 of the support 105, and has first and second legs 110 and 112 located on one of the adjacent side surfaces of the support 105. A strip 114 of each antenna is located on the other adjacent side of the support 105 with a third leg 116 projects from the strip 114 toward the second surface 109 which is parallel to the first surface 108. The first leg 110, second leg 112, and the strip 114 are contiguous with the patch 106 so as to be electrically connected to the patch. A conductive layer 120 on the second surface 109 provides a ground plane.

Each antenna 101-104 has a first port 118 connected between the first leg 110 and the conductive layer 120 on the second surface 109 of the support 105. The second port 119 of each antenna is connected between the third leg 116 and the ground plane, conductive layer 120.

The four antennas 101-104 in FIG. 4 are all identical in configuration and are merely rotated 90 degrees from one another going around the support 105 from one corner to another.

Figure 5:
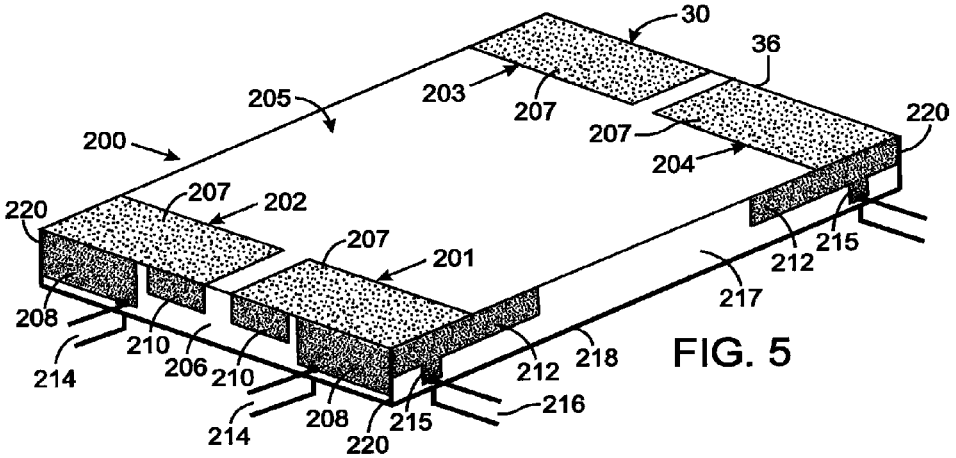
FIG. 5 is a perspective view of another embodiment of an eight port antenna assembly that has antenna elements in the corners of a rectangular support.

FIG. 5 illustrates another version of an eight port antenna assembly 200 in which the antennas at adjacent corners are essentially mirror images of one another. For example, looking at end surface 206 of the support 205 shows that the first and second legs 208 and 210 of the first antenna 201 are mirror images of the first and second legs 208 and 210 of the second antenna 202. Similarly, the combination of the strip 212 and third leg 215 of the first antenna 201 on the side surface 217 is the mirror image of the strip and third leg combination on the adjacent fourth antenna 204. The third antenna 203 is the mirror image of the adjacent antennas 202 and 204.

Every single element antenna 201-204 has a first signal port 214 connected between its first leg 208 and the ground plane 218 and a signal second port 216 connected between its third leg 215 and the ground plane.

Each antenna 201-204 in FIG. 5 has a shorting conductor 220, commonly called a "pin", connected between the ground plane 218 and the patch 207 at the corner of the support 205, where the first leg 208 abuts the strip 212. Because the first leg 208 is electrically conductive, the shorting conductor 220 can be shortened to connect only the lower edge of that leg to the ground plane 218. The shorting conductors 220 are optional and can also be applied to the embodiment in FIG. 5.

Figure 6:
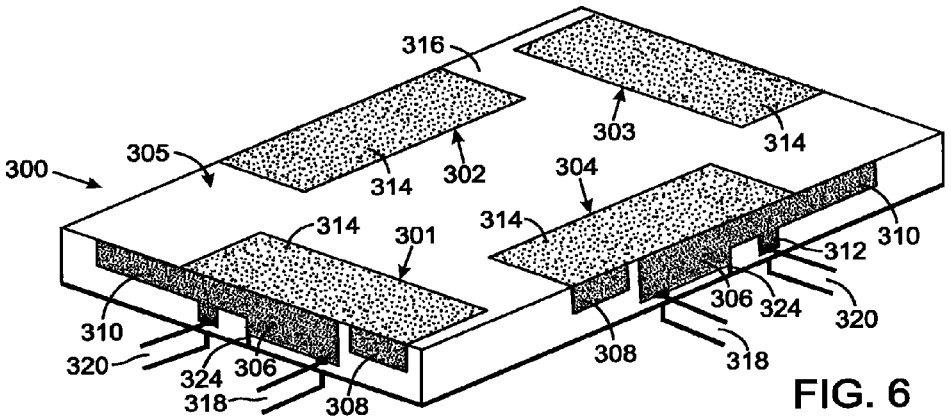
FIG. 6 is a perspective view of an eight port antenna assembly that has antenna elements along each side of a rectangular support.
Figure 7:
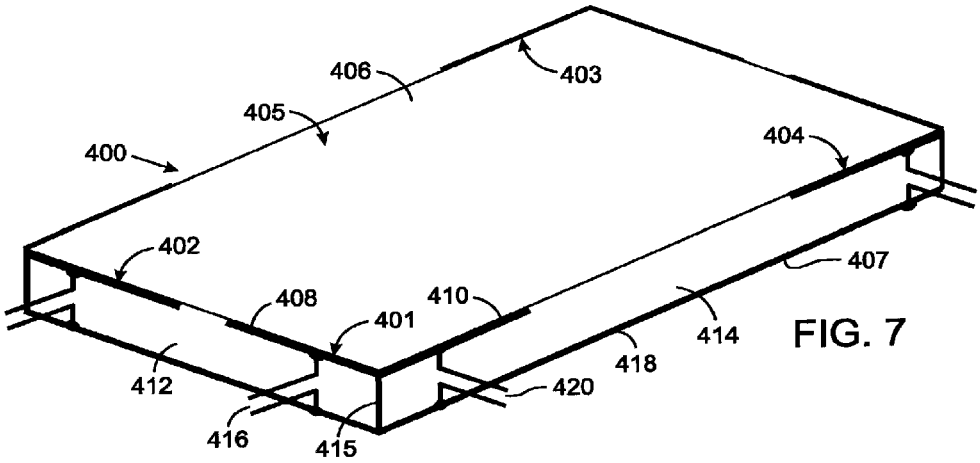
FIG. 7 is a perspective view of another version of an eight port antenna assembly that has antenna elements in the corners of a rectangular support.

With reference to FIG. 6, another embodiment of the an eight-port antenna assembly 300 has the four antennas 301, 302, 303, and 304 located along each side of the support 305 in between the corners. In this assembly, the first and second legs 306 and 308 of the same antenna are coplanar with the strip 310 and its third leg 312. This is in contrast to the previous embodiments in which the first and second legs were located on a surface that was oriented 90 degrees to the surface on which the strip and third leg were located. In antenna assembly 300, each antenna 301-304 may have the same relative orientation of components or some of the antennas can have three legs 306, 308 and 312 and the strip 310 that are mirror images of those components of other antennas. For example, compare the first and fourth antennas 301 and 304, respectively.

The strip 310 and the first and second legs 306 and 308 on a side surface of the support 305 are in electrical contact with the associated patch 314 of the same antenna, wherein the patch is on the first support surface 316. Each antenna 301-304 has a first signal port 318 connected between the first leg 306 and the ground plane 322 and a second signal port 320 connected between the third leg and the ground plane 322.

The antenna assembly 300 also may have the optional shorting conductors 324 located between the ground plane 322 and the end of the first leg 308 that abuts the strip 310 in each antenna 301-304.

The four dual-port antennas in the antenna assemblies illustrated in FIGS. 4-6 can operate simultaneously or individually in the mobile communication device as there is low correlation/coupling among the antennas. Depending upon the manner of excitation applied to the different signal ports, the eight-port antenna assembly can provide frequency diversity or pattern diversity.

Antenna assembly 400 is special case of the present multiple-input, multiple-output antenna in which four dual-port antennas 401, 402, 403, and 404 are located at the corners of a first surface 406 of a substrate 405. An opposite second surface 407 has a the conductive layer 418 thereon. All four of the antennas 401-404 are identical and the details of the first antenna 401 shall be described.

The first antenna 401 has a first electrically conductive strip 408 extending along an edge where the first surface 106 abuts an orthogonal third surface 412. The first strip 104 abuts and is contiguous with a second strip 410 that extends from the substrate corner along another edge of the first surface 406 that abuts a fourth surface 414. The third and fourth surfaces 412 and 414 form side surfaces of the substrate.

The first antenna 401 includes a first signal port 416 between the first strip 408 and a conductive layer 418, that forms a ground plane on the second surface of the substrate 405. A second signal port 420 of the first antenna 14 provides electrical connection between the conductive layer 418 and the second strip 410. An optional shorting conductor 415 extends along the corner edge between the third and fourth surfaces 412 and 414 providing an electrical connection of the first and second strips 408 and 410 to the conductive layer 418.

Figure 8:
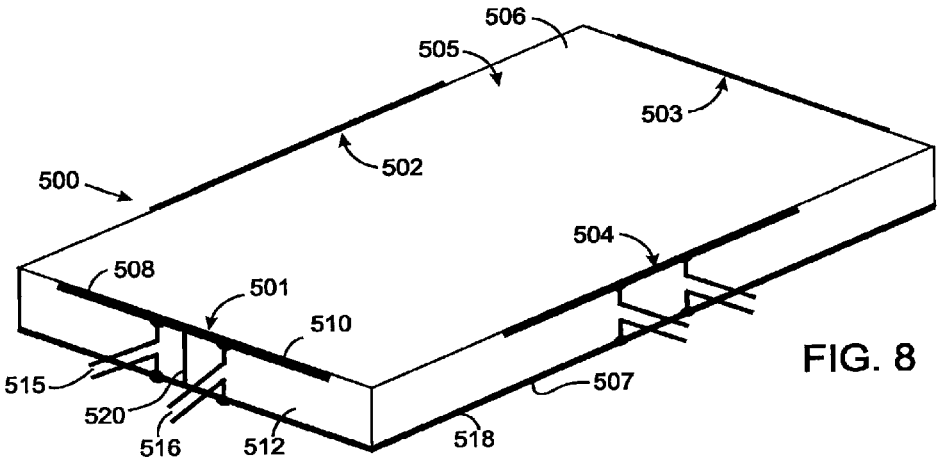
FIG. 8 is a perspective view of a further version of an eight port antenna assembly that has antenna elements in the corners of a rectangular support.

A further version of an eight-port antenna assembly 500 is shown in FIG. 8 and comprises four antennas 501, 502, 503, and 504. Each of those antennas is located midway along one edge of a first surface 506 of a substrate 505 and of are identical design. An opposite second surface 507 has a the conductive layer 518 thereon thereby forming a ground plane.

The first antenna 501 has first and second strips 508 and 510 that are contiguous and aligned with each other along the edge of the first surface 506 that abuts and orthogonal third surface 512. A first signal port 515 provides a connection between the first strip 508 and the conductive layer 518 on the second a surface 507. A second signal port 516 provides connection between the conductive layer 518 and the second strip 510. An optional shorting conductor 520 extends from the interface between the first and second conductive strips 508 and 510 and the conductive layer 518.

The foregoing description was primarily directed to a certain embodiments of the antenna. Although some attention was given to various alternatives, it is anticipated that one skilled in the art will likely realize additional alternatives that are now apparent from the disclosure of these embodiments. Accordingly, the scope of the coverage should be determined from the following claims and not limited by the above disclosure.

The invention claimed is:

1. An antenna assembly for a mobile wireless communication device comprising:

a support having a first surface and a second surface between which at least one side surface extends;

a conductive layer on the second surface; and a first antenna located on the support and comprising:

a first strip of electrically conductive material extending along an edge at which the side surface abuts the first surface, said first strip being of uniform width along said edge;

a second strip of electrically conductive material extending along the edge at which the side surface abuts the first surface and contiguous with the first strip and said second strip being of uniform width along said edge;

a first signal port connected at the first strip for applying a first signal to the first strip; and a second signal port connected at the second strip for applying a second signal to the second strip.

2. The antenna assembly as recited in claim 1 wherein the first strip and the second strip are located along different edges at which the first surface abuts different side surfaces of the support.

3. The antenna assembly as recited in claim 1 further comprising a shorting conductor providing an electric current path between the conductive layer and the first and second strips at a point at which the first strip abuts the second strip.

4. The antenna assembly as recited in claim 1 further comprising a second antenna located on the support and comprising:

a third strip of electrically conductive material extending along the edge of the first surface;

a fourth strip of electrically conductive material extending along the edge of the first surface and contiguous with the third strip;

a third signal port connected at the third strip for applying a third signal to the third strip; and a fourth signal port connected at the third strip for applying a fourth signal to the fourth strip.

5. The antenna assembly of claim 1 wherein the first strip and the second strip form part of first and second inverted F antenna elements, respectively.

6. The antenna assembly of claim 1, wherein the first strip and the second strip abut at a corner of the support.

7. The antenna assembly of claim 4, wherein the third strip and the fourth strip abut at a corner of the support.

8. The antenna assembly of claim 6, wherein the third strip and the fourth strip abut at a first corner of the support.

9. The antenna assembly of claim 8, wherein the first strip and the second strip abut at a second corner of the support.

10. The antenna assembly of claim 1 wherein the conductive layer on the second surface is a ground plane substantially parallel to the first surface.

11. The antenna assembly of claim 1 wherein the first surface and the side surface are orthogonal to each other.

12. An antenna assembly for a mobile wireless communication device comprising:

a support having a first surface and a second surface between which extend a four side surfaces;

a conductive layer on the second surface; and a plurality of antennas located on the support and each comprising:

a first strip electricity conductive material extending along an edge at which a distinct one of the side surfaces abuts the first surface, said first strip being of uniform width along said edge;

a second strip of electrically conductive material contiguous with the first strip and extending along the edge at which the distinct one of the side surfaces abuts the first surface and said second strip being of uniform width along said edge;

a first signal port connected at the first strip for applying a first signal to the first strip; and a second signal port connected at the second strip for applying a second signal to the second strip.

* * * * *